United States Patent [19]

Kulesza et al.

[11] 4,186,926

[45] Feb. 5, 1980

[54] GAME WITH UPSTANDING TRANSPARENT ENCLOSURE AND MOVABLE FIRING MEANS

[75] Inventors: Ralph J. Kulesza, Chicago; Jeffrey D. Breslow, Highland Park, both of Ill.

[73] Assignee: Marvin Glass & Associates, Chicago, Ill.

[21] Appl. No.: 829,566

[22] Filed: Aug. 31, 1977

[51] Int. Cl.[2] ..... A63F 7/00; A63B 63/04

[52] U.S. Cl. ..... 273/340; 124/79; 273/357; 273/379; 273/384; 273/399

[58] Field of Search ..... 273/101, 103, 102.1 G, 273/109 R

[56] References Cited

U.S. PATENT DOCUMENTS

| | | | |
|---|---|---|---|
| D. 235,151 | 9/1973 | Hashimoto | 273/101 |
| 1,319,372 | 10/1919 | Biertuempfel | 273/101 |
| 1,681,682 | 8/1928 | McVey | 273/101 |
| 2,230,814 | 2/1941 | Roth | 273/102.1 G |
| 2,835,495 | 5/1958 | Lohr et al. | 273/101 |
| 3,108,808 | 10/1963 | Peterson | 273/101 |
| 3,254,892 | 6/1966 | Mehelich | 273/101 |
| 3,781,010 | 12/1973 | Matsumoto | 273/85 C |
| 3,958,806 | 5/1976 | Brown | 273/1.5 R |
| 4,025,074 | 5/1977 | Hodges | 273/101 |

FOREIGN PATENT DOCUMENTS

| | | | |
|---|---|---|---|
| 109733 | 1/1928 | Austria | 273/101 |
| 646646 | 10/1962 | Italy | 273/101 |

*Primary Examiner*—Richard C. Pinkham
*Assistant Examiner*—Lawrence E. Anderson
*Attorney, Agent, or Firm*—Mason, Kolehmainen, Rathburn & Wyss

[57] ABSTRACT

An amusement device for use by opposing players includes an upstanding enclosure having spaced apart transparent side walls permitting the interior to be viewed by players on opposite sides. The enclosure includes a bottom wall with a pair of spaced apart parallel openings and a plurality of projectiles, such as table tennis balls, are contained within the enclosure and are adapted to be fired upwardly from the bottom wall. Each player is provided with a movable firing unit or "cannon" which he positions beneath the opening in the bottom wall on his side and the firing unit is then manually operated to propel or fire a selected ball upwardly towards a target. Each player is provided with a target device having an open upper end for receiving the balls and holding a selected number of balls in a vertical stack. The player being first able to collect a selected number of the balls in his target device is the winner and the players may fire balls towards an arm on an opposing player's target device to cause the device to dump out one of the balls already collected. Thus, the game involves both offensive and defensive strategy as well as mechanical skill in aiming and firing the balls.

20 Claims, 8 Drawing Figures

Fig 1
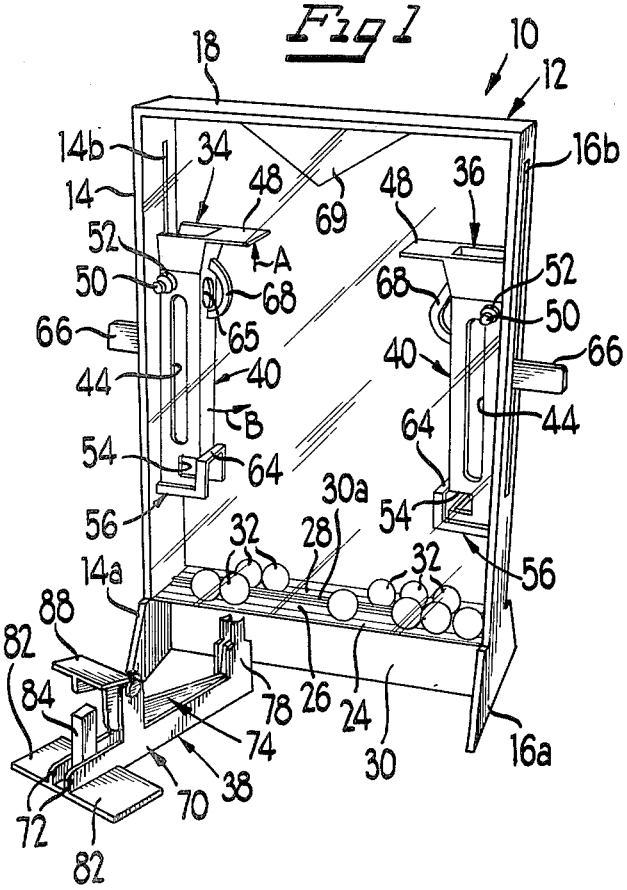
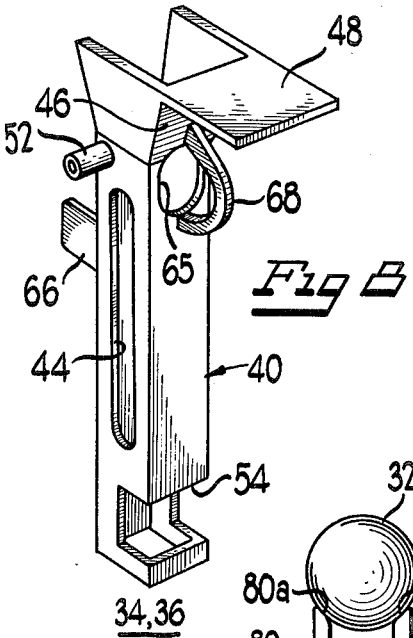
Fig 8
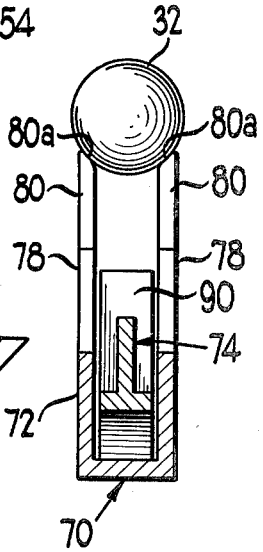
Fig 7
Fig 6
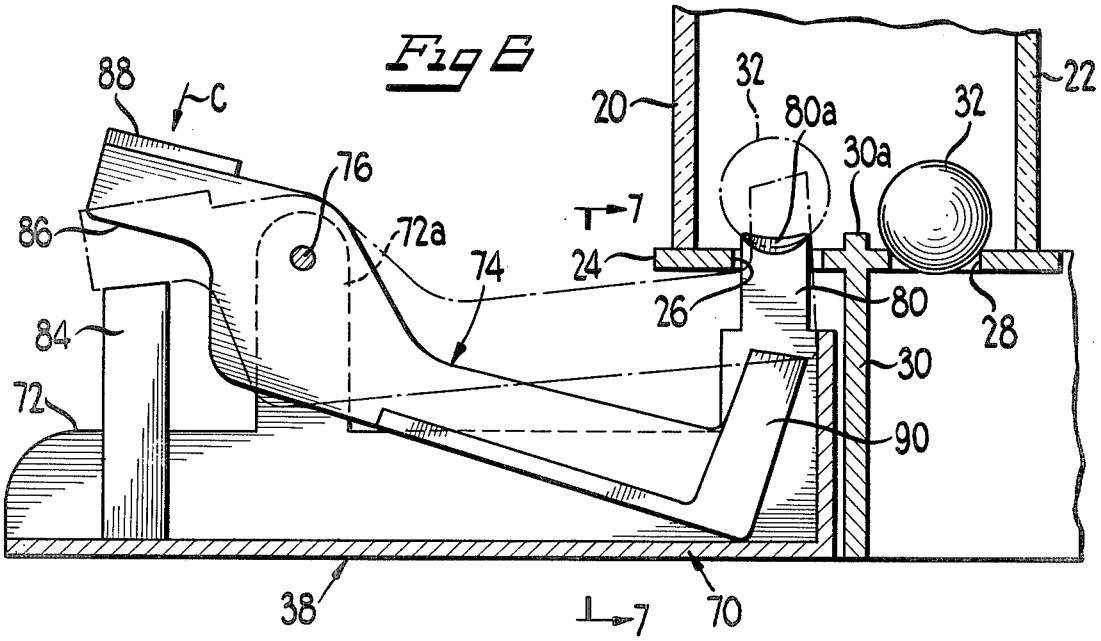

GAME WITH UPSTANDING TRANSPARENT ENCLOSURE AND MOVABLE FIRING MEANS

BACKGROUND OF THE INVENTION

1. Field of the Invention

The present invention is directed toward an amusement device for use by two players in competition and in playing a game utilizing both offensive and defensive strategy. In addition, manual or physical skills as well as mental thought is used to successfully overcome an opponent's and win the game.

2. Description of the Prior Art

The Japanese have developed and played a game called "Pachinko" in which balls or projectiles are fired upwardly into a vertical enclosure to then fall downwardly on a tortuous path contacting various scoring devices and compiling a score total when the balls finally come to rest at a lower end of the enclosure.

A wide variety of pin ball machines have been provided wherein balls are propelled or fired in a skilled manner toward an upper end of an enclosure to subsequently roll down a slanted board on a tortuous path making contact with various counters, bumpers, and scoring devices and finally providing a total score before coming to rest. The score is somewhat dependent on the skill of the operator in propelling or firing a ball initially and thereafter in manipulating the ball with manually controllable flippers or other elements as it rolls downwardly on the sloped floor of the enclosure.

In both types of games, the players do not directly touch the balls and the balls are contained within a glass or "Plexiglass" covered enclosure so as to be viewed from an external position.

The present invention involves an amusement device for use by two players in competition and involves mental strategy of both offensive and defensive nature in addition to physical skills.

It is an object of the present invention to provide a new and improved amusement device or game for use by two players in competition.

More particularly, it is an object of the present invention to provide an amusement game of the character described wherein mental and physical skills are both required.

Another object of the present invention is to provide a new and improved amusement game for use by two players in competition wherein the players use both offensive and defensive strategies for winning the game.

Another object of the present invention is to provide a new and improved amusement game of the character described wherein a plurality of balls or other projectiles are contained within an upstanding enclosure having transparent opposite side walls permitting the interior of the enclosure to be viewed on opposite sides during the play.

Yet another object of the present invention is to provide a new and improved amusement game of the character described having novel target means for each player mounted within the enclosure for receiving and containing the projectiles fired upwardly by the players.

Another object of the invention is to provide a new and improved amusement device of the character described wherein each player has a firing device adapted to be manually positioned and operated to project or "fire" a ball upwardly within an enclosure toward a target device.

SUMMARY OF THE INVENTION

The foregoing and other objects and advantages of the present invention are accomplished in an illustrated embodiment thereof comprising a new and improved amusement device for use by two players in competition. The game device includes an upstanding enclosure having a pair of spaced apart transparent side walls which permit the interior of the enclosure to be viewed by opposing players on opposite sides during the game. The enclosure includes a bottom wall having a pair of spaced apart parallel openings or slots and a plurality of balls or projectiles are contained within the enclosure and are adapted to be projected or fired upwardly from the bottom wall by means of manually positioned firing devices operated by the players. The firing units are moved as desired and are used to propel a player's ball upwardly toward a target device in the enclosure. Each player is provided with a target for containing and holding a number of balls and in playing the game, each player attempts to fill his target device with a selected number of balls while preventing his opponent from doing so. In this connection, the target devices will release balls already collected if an arm thereon is hit by a ball and thus a player may employ a strategy in which he tries to dump his opponent's balls from the target device. Thus, the game device requires the employment of both mental and physical skills and both offensive and defensive strategies are useful.

BRIEF DESCRIPTION OF THE DRAWINGS

For a better understanding of the present invention reference should be had to the following detailed description, taken in conjunction with the drawings, in which:

FIG. 1 is a perspective view of an amusement device constructed in accordance with the features of the present invention and illustrating the device as it is seen by a player operating on one side;

FIG. 6 is a side elevational view of a movable firing unit in accordance with the invention in position ready for firing a ball and, in phantom lines, the unit is shown in another of its operative positions;

FIG. 7 is a transverse cross-sectional view taken substantially along lines 7—7 of FIG. 6; and FIG. 8 is an enlarged perspective view of a target device in accordance with the features of the present invention.

DESCRIPTION OF THE PREFERRED EMBODIMENT

Figure 2:
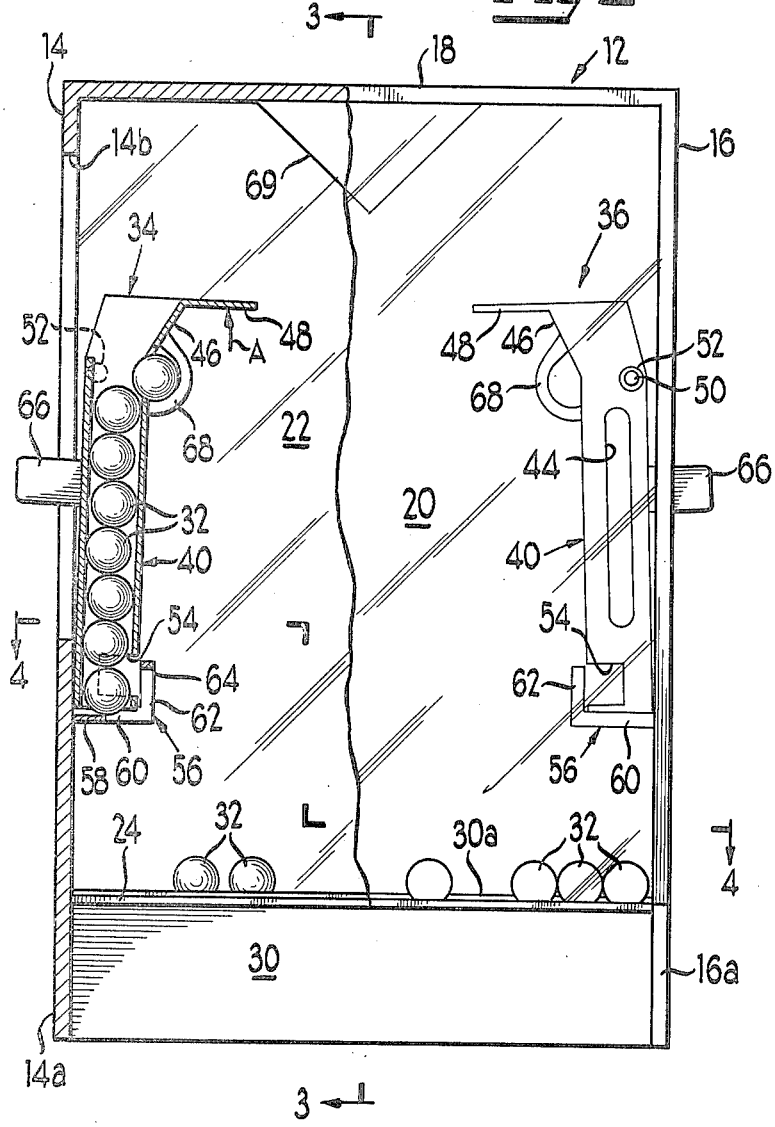
FIG. 2 is an elevational view of the amusement device.

Referring now more particularly to the drawings, in FIG. 1 is illustrated a new and improved amusement game device designed for use by two or more players in competition and referred to generally by the reference numeral 10. The device includes a hollow enclosure 12 formed by a pair of upright side frame members 14 and 16 interconnected adjacent their upper ends by a top wall 18. At the bottom, the side frames 14 and 16 are formed with enlarged outwardly spread feet portions 14*a* and 16*a*, respectively, which aid in supporting and stabilizing the enclosure 12 in a vertically upright position as shown.

Figure 3:
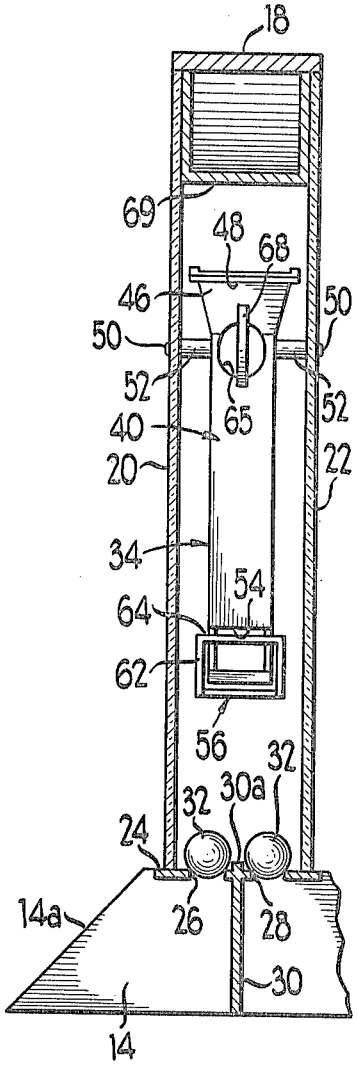
FIG. 3 is a vertical cross-sectional view taken substantially along lines 3—3 of FIG. 2.
Figure 4:
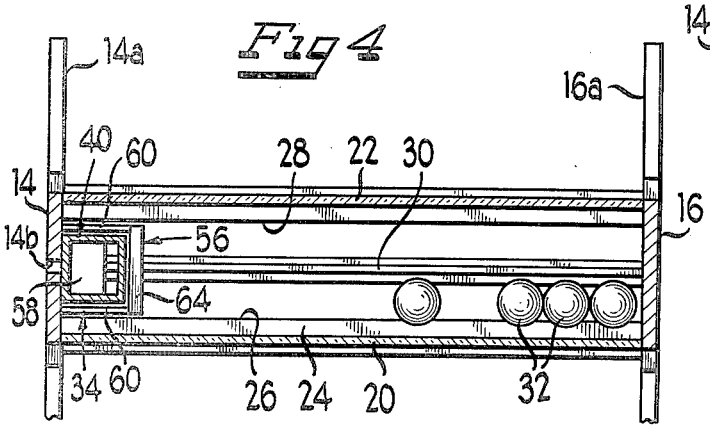
FIG. 4 is a horizontal sectional view taken substantially along lines 4—4 of FIG. 3.

On opposite sides, the enclosure is provided with a pair of transparent side walls 20 and 22 preferably formed of clear plastic or glass and these walls permit the interior of the enclosure to be viewed by the contesting players from opposite sides. Along the bottom edge of the side walls there is provided an elevated bottom wall 24 having a pair of elongated parallel slots 26 and 28 spaced adjacent the respective transparent side walls 20 and 22 as best shown in FIGS. 3, 4 and 6. Below the bottom wall 24, and between the slots 26 and 28 therein, there is provided a vertical stop wall 30 extending between the foot portions 14*a* and 16*a*. As best shown in FIG. 6, an upper edge portion 30*a* of the stop wall projects a short distance above and is integral with the bottom wall 24.

In accordance with the invention, the enclosure 12 is adapted to hold and contain a plurality of round projectiles or balls such as table tennis balls 32 and the balls are appropriately color coded (for example, red and blue) or otherwise identified to correspond to the opposing players or teams. The players are provided with left and right target devices 34 and 36, respectively, which are pivotally mounted within the enclosure 12 adjacent opposite side frame members 14 and 16, respectively. The targets are adapted to contain and hold a selected number of the balls 32 in a vertical stack as best shown in FIG. 2. One or more ball firing or propelling devices 38, called cannons, are provided so that the players may fire selected balls 32 upwardly in the enclosure 12 and attempt to fill up their own target device before an opposing player. The target devices 34 and 36 are identical in structure and each includes an elongated hollow tubular body 40 of generally square transverse cross-section which is dimensioned large enough to accommodate the table tennis balls 32 as shown. Opposite side walls of the target bodies are formed with longitudinal viewing slots 44 which permit the players to visually determine the number of balls 32 contained therein. The tubular body 40 of each target is open at its lower end and at the upper end is provided with a funnel-like sloped wall portion 46 of generally trapezoidal shape which enlarges the open upper end of the target device in order to more easily receive the balls 32 that are fired upwardly in the enclosure as they fall back downwardly toward the bottom wall 24. In this connection, the slotted opposite side walls of the body taper outwardly adjacent the open upper end to provide the funnel-like area for receiving the balls, which, once received, are passed downwardly towards the lower end portion of the target body. Each target device includes a generally horizontal target arm 48 extending toward the opposite target and when struck from the underside by an upwardly fired ball as indicated by the arrow "A" (FIGS. 1 and 2), the arm causes the lower end portion of the target body to move away from the adjacent side frame member 14 or 16 as indicated by the arrow "B" in FIG. 1.

Figure 5:
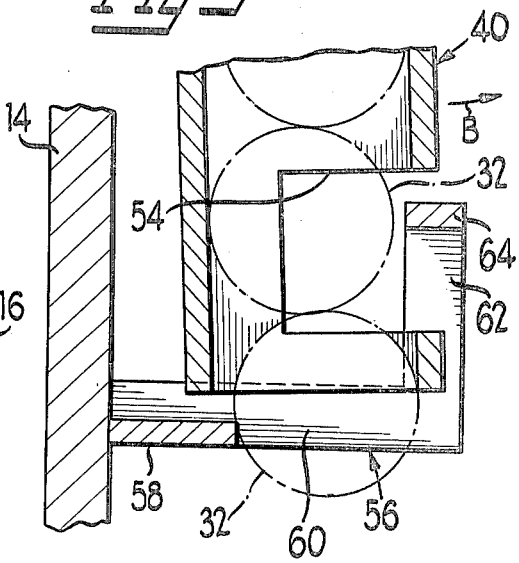
FIG. 5 is an enlarged fragmentary elevational view showing a lower portion of a target device in accordance with the invention wherein the target is in one of its operative positions.

The respective targets are supported on axle members 50 such as headed rivets which extend inwardly from the opposed, spaced apart, transparent side walls 20 and 22 into integral bosses 52 formed on the opposite sides of the opposite sides of the slotted walls of the target body adjacent an upper end portion. The bosses are spaced outwardly of the central longitudinal axis of the hollow body and because of this eccentric location of the pivot axis, the target devices are biased toward the generally vertical positions as shown in FIGS. 1 and 2 wherein the outer side walls of the targets are in contact with the inside surface of the adjacent side frame members 14 and 16 at the lower end of the target body. The upwardly moving balls 32 which forcefully strike the underside of a target arm 48 causing the lower end portion of the target body to pivot away from the adjacent side frame member of the enclosure. When this occurs, the lowermost ball 32 contained in the stack of balls in the hollow body 40 is dumped out or discharged to fall to the bottom of the enclosure. The opposite side walls and the inwardly facing side walls of each target body 40 are formed with an enlarged slot or discharge opening 54 which is dimensioned to accommodate and cooperate with fixed gate assembly 56 formed on the inside surface of a respective side frame members 14 and 16 of the enclosure. Each side gate 56 includes a rectangular horizontal bottom wall 58 normally partially closing the open lower end of the target body 40 and thereby preventing the balls from discharging when the target body is in the normally upright position as shown in FIGS. 1 and 2. The fixed gate assembly also includes a pair of outwardly extending side fingers 60 and an inverted, U-shaped stop element 62 is integrally joined to the outer ends of the fingers as best shown in FIG. 5. The stop element 62 includes an upper, horizontal cross-bar 64 which passes through the slot or discharge opening 54 adjacent the lower end of a target body. Engagement of the cross-bar with the vertical edges of the slots in the side walls limits the pivotal movement of the lower portion of the target body away from the adjacent side frame member of the enclosure and this ensures that only a single ball 32 in the lowermost position within the body is released each time. As illustrated best in FIG. 5, when the target body is pivoted with its lower end moving in the direction of the arrow "B" away from the normal upright position of FIGS. 1 and 2, only the lowermost ball 32 in the target body falls outwardly through the open lower end of the target. During this interval, the second ball in the stack moves down to occupy the lowermost position but the third ball in the stack is momentarily retained from falling downwardly into the second position by the cross-bar 64 of the stop element 62. When the lower end of the target bodies pivots back to the normal upright position (under the influence of gravity because of the eccentric pivotal mounting), the lowermost ball 32 now contained therein is prevented from falling out by the fixed bottom wall 58 until pivotal movement in the direction of arrow "B" again occurs.

It will thus be seen that each time a target is pivoted from a normal upright position towards the position of FIG. 5 and returned, only a single lowermost ball 32 is released. In order to manually release the balls in the target devices 34 and 36 at the end of a game, the targets include a manual discharge lever 66 which extends outwardly through respective vertical slots 14*b* and 16*b* provided in the side frame members of the enclosure. Thus, after the game has been completed, the players can manually toggle the levers 66 to release all of the balls in the target devices 36 and 34 and the balls of course, fall to the bottom wall 24 of the enclosure and rest on the edges of the elongated slots 26 and 28 ready for the next game.

In order to visually indicate to the players when a target 34 or 36 is filled up with the particular number of balls 32 required to win the game (for example, eight as shown in FIG. 2) each target body 40 is formed with an opening 65 adjacent an upper level which is large enough to permit a ball at the adjacent level in the target body to move outwardly into a visual containment ring 68 which is integrally joined to the side wall. When a ball is visible in position within a containment ring, the game is over and the first player with a ball 32 in this position wins the game.

In order to facilitate entry of the balls into the funnel-like upper ends of the respective targets 34 and 36, a V-shaped ball deflector 69 is attached to the underside of the top wall 18 of the enclosure. The deflector 69 includes sloping deflection surfaces extending upwardly and outwardly in opposite directions from a lowest point at the middle of the enclosure 12. The vertically upwardly traveling balls 32 are deflected by these surfaces outwardly and the balls fall towards the funnel-like open upper ends of the respective target devices 34 and 36. If the balls do not have enough upward velocity when striking the deflecting surfaces of the deflector 69, they will simply fall straight back downwardly between the pair of targets or if the balls are moving at too high a velocity, they will be deflected almost horizontally outwardly and may then rebound back towards the center of the enclosure and fall back down between the targets. Accordingly, manual skill and dexterity in aiming and firing the balls is required.

The firing devices or cannons 38 include a channel-shaped base 70 having a pair of upstanding side walls 72 spaced apart to accommodate a firing element 74 which is pivotally secured intermediate its ends on an axle 76 extending transversely between a pair of upstanding fingers 72*a* of the base. At the forward end, the cannon base includes a pair of upstanding ball lift elements or fingers 78 each having a narrowed upper portion 80 with a concave inwardly sloping end surface 80*a* adapted to receive and centrally position a selected ball 32 in a ready position. It should also be noted that the narrow upper end portions 80 are of a dimension somewhat less than the transverse width of the slots 26 and 28 in the bottom wall 24 of the enclosure so that some leeway in position adjustment of the cannon is permitted once the upper end portions 80 are extended up into the slots to elevate a ball 32 above the upper surface of the bottom wall 24 of the enclosure as shown in FIG. 6.

In the ready position, a ball is automatically centered by the surfaces 80*a* of the elements 80 and is ready to be fired. The cannons 38 may be moved laterally across the width of the enclosure 12 to pick up any of the balls 32 that are available and resting in the adjacent slot 26 or 28 on the players side. A stop wall 30 prevents a cannon 38 on one side from interfering with the cannon on the opposite side of another player and permits balls in one slot only to be fired with a cannon on one players side of the enclosure. The wall helps in lining up the fingers 80 within the slots 26 and 28 during manual positioning of the cannons as described.

At the outer end, each cannon base 70 is provided with a pair of laterally outwardly extending feet or wings 82 which stabilize the cannon and ensure that the fingers 80 supporting a ball 32 are in a vertical disposition so that an accurate shot can be made. The bases 70 also include an upstanding stop element 84 which is adapted to engage a lower edge surface 86 on the outer or trigger end portion of the firing element 74. The firing elements include a trigger pad 88 which is pressed downwardly with variable force as indicated by the arrow "C" in FIG. 6 causing the forward end or firing pin 90 to move upwardly between the ball supporting portions 80 to engage and propel or fire a ball upwardly. As viewed in FIG. 6, it will be seen that the pivot axis of the pin 76 is eccentric with respect to the body length of the firing element 74 so that after manual pressure is released from the trigger pin 88, gravity biases the firing element back to the position shown in solid lines wherein the upper end of the firing pin 90 is spaced below the upper end surfaces 80*a* of the ball support finger elements 80. It should also be noted that engagement of the lower edge portion 86 of the firing element with the upper end surface of the stop member 84 limits the upward movement of the firing pin 90 when the cannon is fired and this position is indicated in dotted lines on FIG. 6.

It will thus be seen that skill is needed in selecting a particular ball 32 in the enclosure to be fired and in firing the ball upwardly, either towards a target arm 48 of an opposing player's target device 34 or 36 or when firing a ball to be received in the upper open end portion of a player's own target. Offensive or defensive strategy is involved in determining which ball to shoot and whether to shoot one of your balls toward your own target in hopes of adding another ball to those already collected in your target body or in shooting toward the target arm 48 of your opponent to release a ball from the opposing player's target.

Although the present invention has been described with reference to a single illustrated embodiment thereof, it should be understood that numerous other modifications and embodiments can be devised by those skilled In the art that will fall within the spirits and scope of the principles of this invention.

What is claimed as new and desired to be secured by Letters Patent of the United States is:

1. An amusement device for use by two players in competition comprising:

an upstanding enclosure having spaced apart transparent side walls permitting the interior to be viewed by opposing players on opposite sides thereof, said enclosure having a bottom wall with a pair of spaced apart parallel openings adjacent said opposite side walls, a plurality of projectiles in said enclosure adapted to be projected upwardly of said bottom wall between said side walls, said openings being dimensioned small enough in a first direction so said projectiles do not fall through said openings, said openings being larger than a plurality of projectiles in a second direction, selectively repositionable firing means for each player positioned outside said enclosure and separate and apart therefrom for movement to any point below one of the paralleled openings with a firing element thereof spaced below one of said parallel openings in said bottom wall and capable of movement to various points within said opening in a second direction, said firing means manually operable by a player to move said element thereof upwardly into a portion of one of said openings to engage and fire a selected projectile upwardly in said enclosure without directly striking other projectiles positioned in said openings, and target means for each player mounted in said enclosure having an open upper end for receiving and containing projectiles fired upwardly in said enclosure and including means for holding a selected number of said projectiles, selectively operable releasing means for releasing projectiles within said target means, a player being able to first collect said selected number of projectiles in his target means winning the competition.

2. The amusement device of claim 1 wherein said target means comprises:

an elongated hollow body pivotally supported adjacent an upper end portion at an elevated level in said enclosure and dimensioned to hold a plurality of said projectiles in an upwardly disposed stack therein, and means adjacent a lower end of said body for releasing projectiles from said stack to fall toward said bottom wall of said enclosure.

3. The amusement device of claim 2 wherein said releasing means is operable to release a lower projectile from said stack contained in said body upon pivotal movement of said body from a normally upright holding position to a sloped releasing position.

4. The amusement device of claim 1 wherein at least one of said firing means includes:

a base, a firing lever pivotally mounted on said base intermediate its ends and supporting said firing element in an upstanding position and a trigger element adjacent an opposite end of said lever adapted to be downwardly depressed to move said firing element rapidly upward to fire a projectile upwardly in said enclosure.

5. The amusement device of claim 4 including stop means for limiting the pivotal movement of said lever when said trigger element is depressed.

6. The amusement device of claim 4 wherein the firing means includes leg means adjacent said forward end adapted to support a projectile in position ready to be fired when said leg means is extended upwardly into said bottom wall opening of said enclosure.

7. The amusement device of claim 6 wherein said leg means includes a pair of upstanding legs disposed on opposite sides of said firing element, said legs having upper surfaces shaped to center said projectiles above an upper end of said firing element.

8. The amusement device of claim 6 including means for supporting said enclosure in an upright position with said bottom wall spaced above a supporting surface on which said firing means are resting, said spacing between said bottom wall and said supporting surface being dimensioned to permit said leg means of said firing means to project upwardly into said enclosure through said openings of said bottom for supporting said projectiles in firing positions above said bottom wall.

9. The amusement device of claim 8 wherein said supporting means includes wall means between said openings depending downwardly of said bottom wall for aiding in alignment of said firing means on opposites thereof with the leg means of said firing means projecting into said respective openings.

10. An amusement device for use by two players in competition comprising:

an upstanding enclosure having spaced apart transparent side walls permitting the interior to be viewed by opposing players on opposite sides thereof, said enclosure having a bottom wall with a pair of spaced apart parallel openings adjacent said opposite side walls;

a plurality of projectiles in said enclosure adapted to be projected upwardly of said bottom wall between said side walls, said projectiles being dimensioned large enough not to fall through said openings in said bottom wall;

movable firing means for each player positioned outside said enclosure and adapted to be selectively repositioned with a firing element thereof spaced below one of said parallel openings in said bottom wall, said firing means manually operable by a player to move said element thereof upwardly into one of said openings to engage and fire a projectile upwardly in said enclosure;

target means for each player mounted in said enclosure having an open upper end for receiving and containing projectiles fired upwardly in said enclosure and including means for holding a selected number of said projectiles, a player being able to first collect said selected number of projectiles in his target means winning the competition, said target means comprising an elongated hollow body pivotally supported adjacent an upper end at an elevated level in said enclosure and dimensioned to hold a plurality of said projectiles in an upwardly disposed stack therein and means adjacent a lower end of said body for releasing projectiles from said stack to fall toward said bottom wall of said enclosure, said releasing means being operable to release a lower projectile from said stack contained in said body upon pivotal movement of said body from a normally upright holding position to a sloped releasing position; and means for limiting said pivotal displacement of said lower end of said body to permit release of only the lowest projectile in said stack each time said body is momentarily pivoted from said holding position to said releasing position.

11. The amusement device of claim 10 wherein said body is pivotally supported on an axis offset from said stack whereby the weight of projectiles in said stack biases said body in a direction away from said releasing position.

12. An amusement device for use by two players in competition comprising:

an upstanding enclosure having spaced apart transparent side walls permitting the interior to be viewed by opposing players on opposite sides thereof, said enclosure having a bottom wall with a pair of spaced apart parallel openings adjacent said opposite side walls;

a plurality of projectiles in said enclosure adapted to be projected upwardly of said bottom wall between said side walls, said projectiles being dimensioned large enough not to fall through said openings in said bottom wall;

movable firing means for each player positioned outside said enclosure and adapted to be selectively repositioned with a firing element thereof spaced below one of said parallel openings in said bottom wall, said firing means manually operable by a player to move said element thereof upwardly into one of said openings to engage and fire a projectile upwardly in said enclosure;

target means for each player mounted in said enclosure having an open upper end for receiving and containing projectiles fired upwardly in said enclosure and including means for holding a selected number of said projectiles, a player being able to first collect said selected number of projectiles in his target means winning the competition, said target means comprising an elongated hollow body pivotally supported adjacent an upper end at an elevated level in said enclosure and dimensioned to hold a plurality of said projectiles in an upwardly disposed stack therein and means adjacent a lower end of said body for releasing projectiles from said stack to fall toward said bottom wall of said enclosure, said releasing means being operable to release a lower projectile from said stack contained in said body upon pivotal movement of said body from a normally upright holding position to a sloped releasing position; and a target element extending outwardly from said body adjacent said upper end adapted to pivot said body toward said releasing position when struck by an upwardly fired projectile.

13. The amusement device of claim 12 including a lever element manually actuable from outside said enclosure for pivoting said body to release a projectile from said stack.

14. The amusement device of claim 12 wherein said releasing means comprises a fixed wall aligned for supporting said stack of projectiles on said body when said body is in said holding position, said lower end of said body movable out of alignment with said fixed wall to release the lowest projectile in said stack.

15. The amusement device of claim 12 wherein said body is formed with window means in opposite sides permitting said players to view at least a portion of the stack of projectiles contained in said body from opposite sides of said enclosure.

16. The amusement device of claim 12 wherein said hollow body includes structure for retaining an upper projectile in said stack in a position outwardly offset from the remaining projectiles in said stack therebelow to indicate a winner.

17. The amusement device of claim 16 wherein said structure includes open areas permitting a projectile therein to be viewed from opposite side of said enclosure.

18. The amusement device of claim 12 wherein said enclosure includes a pair of opposite edge walls interconnecting opposite edges of said sidewalls and said target means includes two targets, one each positioned adjacent said edge walls with said target elements thereof extending toward one another.

19. The amusement device of claim 18 wherein the lower portions of said target means are pivoted away from said edge walls when moved toward said releasing positions.

20. The amusement device of claim 18 wherein said enclosure includes a top wall having projectile deflector surfaces spaced between said target means for deflecting upwardly fired projectiles outwardly and downwardly toward the open upper ends of said bodies of said target means.

* * * * *